US008713974B2

(12) United States Patent
Tsuchida et al.

(10) Patent No.: US 8,713,974 B2
(45) Date of Patent: May 6, 2014

(54) KNITTED FABRIC FOR HOOK-AND-LOOP FASTENER

(75) Inventors: Satoshi Tsuchida, Osaka (JP); Toshinori Habe, Kashima-gun (JP)

(73) Assignees: Marubeni Intex Co., Ltd., Osaka (JP); Maruha Tateami Co., Ltd., Ishikawa (JP)

( * ) Notice: Subject to any disclaimer, the term of this patent is extended or adjusted under 35 U.S.C. 154(b) by 0 days.

(21) Appl. No.: 13/521,413

(22) PCT Filed: Jul. 21, 2011

(86) PCT No.: PCT/JP2011/066536

§ 371 (c)(1), (2), (4) Date: Jul. 10, 2012

(87) PCT Pub. No.: WO2012/017830

PCT Pub. Date: Feb. 9, 2012

(65) Prior Publication Data

US 2013/0129964 A1 May 23, 2013

(30) Foreign Application Priority Data

Aug. 6, 2010 (JP) ..... 2010-177519

(51) Int. Cl.
*D04B 21/02* (2006.01)

(52) U.S. Cl.
USPC ..... 66/194; 66/195

(58) Field of Classification Search
USPC ..... 66/195, 191, 192, 193, 194; 442/312
See application file for complete search history.

(56) References Cited

U.S. PATENT DOCUMENTS

| | | | | | |
|---|---|---|---|---|---|
| 4,709,562 | A | * | 12/1987 | Matsuda | 66/193 |
| 4,858,447 | A | * | 8/1989 | Matsuda | 66/191 |
| 5,214,942 | A | * | 6/1993 | Peake et al. | 66/194 |
| 5,449,530 | A | * | 9/1995 | Peake et al. | 427/244 |
| 5,557,950 | A | * | 9/1996 | Richards et al. | 66/194 |
| 5,916,273 | A | * | 6/1999 | Hepfinger | 66/194 |
| 6,096,667 | A | * | 8/2000 | Rhode | 442/313 |
| 6,216,496 | B1 | | 4/2001 | Gehring | |
| 6,282,926 | B1 | * | 9/2001 | Matsuda et al. | 66/192 |
| 6,705,132 | B1 | * | 3/2004 | Hajek | 66/194 |
| 6,845,639 | B1 | | 1/2005 | Hajek | |
| 6,854,297 | B1 | * | 2/2005 | Gehring | 66/203 |
| 7,207,195 | B2 | * | 4/2007 | Okawa | 66/193 |

FOREIGN PATENT DOCUMENTS

| | | | |
|---|---|---|---|
| JP | 2005-118360 | A | 5/2005 |
| JP | 2005-253649 | A | 9/2005 |
| JP | 2010-63585 | A | 3/2010 |
| JP | 2010-63633 | A | 3/2010 |

* cited by examiner

*Primary Examiner* — Danny Worrell
(74) *Attorney, Agent, or Firm* — DLA Piper LLP (US)

(57) ABSTRACT

A knitted fabric for hook-and-loop fastener comprising of tricot stitch for the knitted fabric for hook-and-loop fastener; and the tricot stitch is formed of surface threads, middle threads and backside threads; and each surface threads, middle threads and backside threads has loops at regular intervals, and loops of surface threads are linked to loops of middle threads, and loops of middle threads are linked to loops of backside threads. Furthermore, the piles of surface threads are formed from side to side on the same numbers, and thread direction of a certain loop of surface threads is opposite to thread direction of a corresponding loop of middle threads, and the thread direction of loop of middle threads is opposite to thread direction of a corresponding loop of backside threads.

9 Claims, 11 Drawing Sheets

(B)

Do not copy this report

JSTIIF

FIG.8

No. CK - 10 - 024859

Experimental Report

Client Marubeni Intex Co.,LTD
Item Insertion and looping 2
Examination Tear strength The experimental result of samples that are filed at June 22, 2010 is following:

June 24, 2010

2-5-19, Edobori, Nishi-ku, Osaka
552-0002
Incorporated foundation
Japan Chemical Fiber Inspection Association Osaka office
Fiber laboratory
Tel (06)-6441-0319
Fax (06)-6441-6755

| Examination \ Sample N | | | JSTIIF KAKEN (1) Insertion&loop | JSTIIF KAKI (2) Insertion | Method of examination |
|---|---|---|---|---|---|
| Tear strength (N) | Wale *1 | N=1 | 6. 7(**10mm) | 2. 4 | JIS L 1018 A (Pendulum method) |
| | | N=2 | 6. 6(**10mm) | 3. 4 | |
| | | N=3 | 6. 1(**10mm) | 3. 0 | |
| | | N=4 | 4. 9(**11mm) | 2. 5 | |
| | | N=5 | 6. 6(**12mm) | 2. 1 | |
| | | Average | 6. 2(**11mm) | 2. 7 | |
| | Wale *2 | N=1 | 5. 6(**10mm) | 3. 4 | |
| | | N=2 | 5. 7(**12mm) | 3. 8 | |
| | | N=3 | 6. 8(**14mm) | 3. 4 | |
| | | N=4 | 5. 3(** 5 mm) | 2. 9 | |
| | | N=5 | 6. 8(**12mm) | 2. 5 | |
| | | Average | 6. 0(**11mm) | 3. 2 | |

*1 : Cutting off the fabric by 2cm from upper side

*2 : Cutting off the fabric by 2cm from lower side

** : Remnant of the fabric

This result shows not quality of all items but property of each sample.

| check | writer |
|---|---|
| confirmation Hagiwara | Matsumoto |

Do not copy this report

JSTIIF

FIG.9

No. CK - 10 - 024859-2

Experimental Report

Client Marubeni Intex Co.,LTD
Item Insertion and looping 10
Examination Tear strength The experimental result of samples that are filed at June 22, 2010 is following:

June 24, 2010

2-5-19, Edobori, Nishi-ku, Osaka 552-0002
Incorporated foundation
Japan Chemical Fiber Inspection Association Osaka office
Fiber laboratory
Tel (06)-6441-0319
Fax (06)-6441-6755

| AKEN JSTIIF Sample / Examination | | KAKEN JSTIIF | | | | | KAKEN JSTIIF | | | | | KAKEN JSTII | |
|---|---|---|---|---|---|---|---|---|---|---|---|---|---|
| | | (1) Insertion & Loop 1 | (2) Insertion & Loop 2 | (3) Insertion & Loop 3 | (4) Insertion & Loop 4 | (5) Insertion & Loop 5 | (6) Insertion 1 | (7) Insertion 2 | (8) Insertion 3 | (9) Insertion 4 | (10) Insertion 5 | Method of examination |
| Tear strength (N) | Wale *1 | 6.2 (** 11mm) | 7.1 (** 13mm) | 8.7 (** 14mm) | 8.9 (** 14mm) | 9.1 (** 14mm) | 2.8 | 5.9 | 6.9 | 6.9 | 10.3 (** 23mm) | JIS L 1018 A (Pendulum method) |
| | Wale *2 | 6.0 (** 11mm) | 6.5 (** 12mm) | 7.8 (** 9mm) | 9.3 (** 16mm) | 9.4 (** 19mm) | 2.6 | 4.5 | 5.5 | 6.6 (** 8mm) | 10.7 (** 25mm) | |

*1 : Cutting off the fabric by 2cm from upper side

*2 : Cutting off the fabric by 2cm from lower side

** : Remnant of the fabric

This result shows not quality of all items but property of each sample.

| check | writer |
|---|---|
| confirmation Hagiwara | Matsumoto |

β

KNITTED FABRIC FOR HOOK-AND-LOOP FASTENER

TECHNICAL FIELD

This invention is related to a knitted fabric for hook-and-loop fastener used as female member of a hook-and-loop fastener.

BACKGROUND OF THE INVENTION

An adhesive-backed tape has been used for a long time in order to adhere materials easily, for example, fabric and fabric or cloth and cloth. But an adhesive-backed tape has a problem that the adhesion strength will decline with increasing use as a result of dust or garbage accumulating on the surface of the tape. So, people tend to use a knitted fabric for hook-and-loop fastener instead of an adhesive-backed tape for adhering materials easily.

A tricot stitch is often used as a female member of a hook-and-loop fastener for adhering easily. This tricot stitch for the hook-and-loop fastener needs durability despite being attached and removed many-times, and needs to cut down on the manufacturing cost. It also needs high adhesive strength with engagement members (e.g. male members), and needs high durability of the fabric in order not to tear the fabric when peeling the engagement materials from the fabric.

Some people have tried to make a good knitted fabric for hook-and-loop fasteners addressing these points. For example, JP2005-118360 shows a female material for the purpose of offering fabric for inexpensive and steady hook-and-loop fastener by using polyester fiber.

But a prior female material has a problem that the adhesive strength is different between the left and right directions because the piles are lined up on one side of the left and right. And it has another problem that the piles of the female materials require a lot of thread for making them larger. It has been impossible to make loops of the female material smaller in the prior art, and impossible to make piles larger in the case of the same amount of thread. It costs much to make them larger because a lot of thread is needed. Furthermore, there is another problem that the strength of the fabric tends to be weak because the threads on the backside of the fabric are only linked to the neighboring threads of the middle of fabric and the neighboring threads of the surface of the fabric.

This invention has been developed in order to solve the above problems. This invention's purpose is to offer an inexpensive fabric for the female member of a hook-and-loop fastener, which does not show a difference between the left and right directions in respect of the adhesive strength, which improves the adhesive strength by using a little amount of thread and making large piles, and which improves the fabric tear strength by making loops at the backside threads of the fabric and linking the loops to the loops of middle threads and surface threads.

SUMMARY OF THE INVENTION

According to an aspect of the invention, there is a provided: a knitted fabric for a hook-and-loop fastener comprising: a tricot stitch for the knitted fabric for the hook-and-loop fastener; and the tricot stitch is formed of surface threads, middle threads and backside threads; and the surface threads form piles that are connected to various engagement materials, and the backside threads form base fabric by linking to their neighboring threads, and the middle threads link the surface threads with backside threads; and each surface thread, middle thread and backside thread is knitted by repeating desired stitch patterns; and each surface thread, middle thread and backside thread has loops at regular intervals, and loops of surface threads are linked to loops of middle threads, and loops of middle threads are linked to loops of backside threads.

The knitted fabric for hook-and-loop fastener, wherein the piles of surface threads are formed on alternate sides in desired numbers.

The knitted fabric for hook-and-loop fastener, wherein the piles of surface threads are formed on alternate sides in the same numbers.

The knitted fabric for hook-and-loop fastener, wherein the thread direction of a certain loop of surface threads is opposite to the thread direction of a corresponding loop of middle threads, and the thread direction of loop of middle threads is opposite to thread direction of a corresponding loop of backside threads.

The knitted fabric for hook-and-loop fastener, wherein, if stitch patterns of the tricot stitch are shown as refrain of stitch position from 1 to 9, the stitch pattern of the surface threads is showed as refrain of 5-4/9-8/4-5/0-1, stitch pattern of the middle threads is showed refrain of 0-1/1-0/1-0/0-1 and stitch pattern of the backside threads is showed refrain of 4-3/7-7/3-4/0-0; and tear strength of tricot stitch increases as the result that insert portions of backside threads are connected to neighboring threads and loops of backside threads are linked to loops of middle threads.

The tricot stitch of this invention's knitted fabric for hook-and-loop fastener is composed of surface threads and middle threads and backside threads. Some loops are made at each thread at regular intervals. The loops of middle threads are linked to the loops of surface threads, and the loops of middle threads are also linked to the loops of backside threads.

This invention makes the tear strength stronger by linking the backside threads to the neighboring backside threads and linking the loops of the backside threads to the loops of middle threads, because the backside threads do not get loose easily in the case that a certain portion is cut off.

Concerning the knitted fabric for hook-and-loop fastener of this invention, piles of surface threads composed of tricot stitch are made from side to side every same numbers. So, the adhesive strength is the same in case that engagement materials such a male material adhere to the fabric from the left side and in case that engagement materials adhere to the fabric from the right side. We do not need to consider which directions we should adhere the engagement materials from.

Concerning the knitted fabric for hook-and-loop fastener of this invention, the direction of the threads composed of loops is opposite to between surface threads and middle threads, and between middle threads and backside threads. So, it is possible for us to keep the loops smaller because the looseness of the loops is offset each other. Therefore, we can decrease the amount of threads that are used as loops of surface threads, and we can keep the piles bigger and higher because the amount of threads for piles increases instead of decreasing the amount of surface threads for loops. Concerning the fabric of this invention, the adhesive strength with engagement materials improves by keeping the surface piles bigger and higher.

BRIEF DESCRIPTION OF DRAWINGS

FIG. 8 shows experimental data that shows the tear strength of a knitted fabric for hook-and-loop fastener according to an embodiment FIG. 9 shows experimental data that shows the tear strength of a knitted fabric for hook-and-loop fastener according to an embodiment

DETAILED DESCRIPTION OF THE INVENTION

Figure 1:
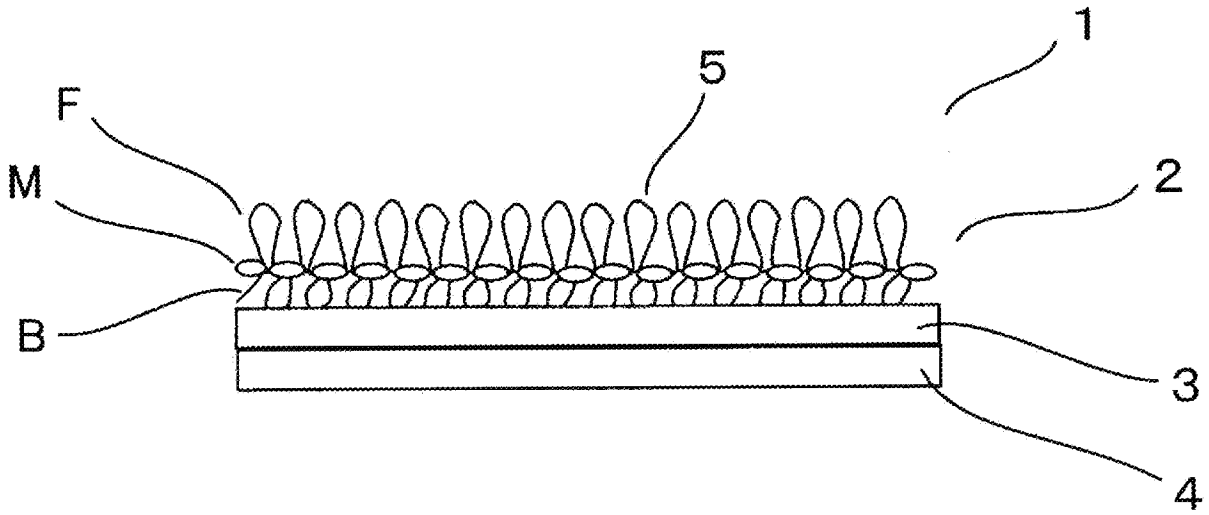
FIG. 1 is a longitudinal view of a knitted fabric for hook-and-loop fastener relating to an embodiment

The female materials for a hook-and-loop fastener mainly comprise base tapes, cohesive layers and tricot stitches. The tricot stitches adhere to the base tapes by the cohesive layers. The surface threads, the middle threads and the backside threads independently have a certain stitch pattern, and the tricot stitches are composed of the combination of the surface threads, middle threads and backside threads.

For example, nylon fiber or polyester may be used as threads for this invention, but the threads are not limited to these fibers.

Tricot stitches of this invention mainly have the following features.

The threads of the backside have insert portions which link to the neighboring threads in the middle and the surface for making the basic fabric, and also have loops at regular intervals. The loops are linked to the loops above formed by the middle threads, and the adhesive strength of the fabric improves.

The threads of the surface part have loops at their center, and form piles alternately at both sides of the center loops. That is to say, a certain loop is formed at the center of the thread, a certain pile is formed at the left side, and a certain loop is formed at the next center of the thread, and a certain loop is formed at the right side. Loops and piles are formed from side to side.

By making piles alternately from side to side for adhering to engagement materials, such as male materials, the fabric has the same adhesive strength in the case of attaching to the engagement materials from either the upper right or from the upper left directions.

The numbers of piles that are formed at one side is optional. For example, it is possible to make piles one by one from side to side, and it is also possible to make two piles at the left side and two piles at the right side.

Further, in the tricot stitch of this invention, loops of surface threads, loops of middle threads and loops of the backside threads are linked to each other at regular intervals. The direction of the surface threads for the loops is opposite to the direction of the middle ones, and the direction of the middle ones is opposite to the direction of the backside ones.

That is to say, in the case where the loops of the surface threads are formed in an anti-clockwise direction, the loops of the middle threads linked to the surface loops are formed in a clockwise direction. Further, the loops of the backside threads linked to the middle loops are formed in an anti-clockwise direction.

The loops of the surface threads, the middle threads and the backside threads get loose and become bigger because a loosening force opposite to the direction of the threads is generated. The piles of the surface threads becomes correspondingly smaller if the loops of surface threads become bigger.

In the present invention, the direction between the surface threads and the middle threads, and the direction between the middle threads and the backside threads are respectively opposite way. So, the loosening force is offset each other because their loops gain opposite loosen force, when each loop gains the loosen force.

That is to say, in case that the backside thread loops gain the loosen force at clockwise rotation, the middle thread loops gain the loosen force at anti-clockwise rotation. So, the loosen force of such loops is offset. In case that the middle thread loops gain the loosen force at anti-clockwise rotation, the surface thread loops gain the loosen force at clockwise rotation. So, the loosen force of such loops is offset. By this invention, we can keep the loops small when the loops gain the loosen force, because the each loosen force is offset.

We can keep each loops small, and also keep surface loops small, therefore, we can keep piles of the surface high and big, because we can spend more amount of threads as the surface piles as the result of keeping surface loops smaller.

The female materials that the knitted fabric for a hook-and-loop fastener of this invention's tricot stitch is applied to are mainly used as disposable hook-and-loop fasteners or a simple adhesive hook-and-loop fastener, especially used as a disposable diaper (nappy). However, possible uses are not limited to these things.

The thread's size used for tricot stitch of this invention can be freely set, and we can decide in relation to the purpose of the hook-and-loop fastener. For example, if the fabric of this invention is used for a disposable diaper (nappy), the surface threads should be thick (or medium size), the middle threads should be thin and the backside threads should be medium size. And for example, if the fabric of this invention is used for other purposes, the surface threads should be thick (or medium size), the middle threads should be medium size (or thin) and the backside threads should be thick. Although these sizes are favorable, the sizes are not limited to these examples.

Embodiment 1

We will explain a desirable embodiment of this invention's fabric, referring to FIGS. 1 to 3 and 5 to 11. Further, in FIGS. 6 and 7, broken lines represent surface threads (F), solid lines represent middle threads (M), and dotted lines represent backside threads (B).

As FIG. 1 shows, this invention's female materials of fabric for a hook-and-loop fastener (1) mainly comprise a tricot stitch (2), a cohesive layer (3) and a base tape (4). The tricot stitch comprises surface threads (F), middle threads (M) and backside threads (B).

The backside threads (B) form a backing fabric by linking to neighboring threads. The backside threads are adhered to the base tape (4) through the cohesive layer (3).

Figure 3:
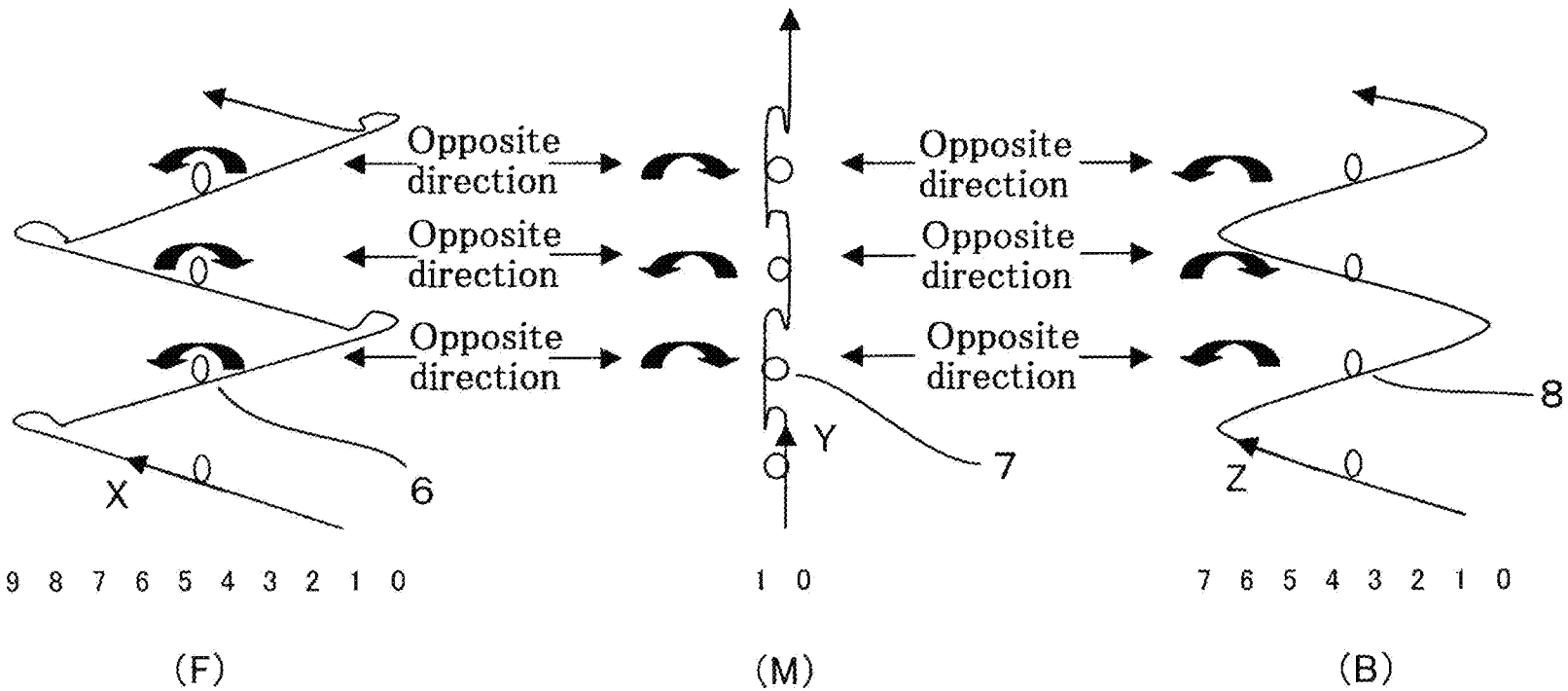
FIG. 3 is an explanatory view of a stitch pattern among surface threads, middle threads and backside threads of a knitted fabric for hook-and-loop fastener according to an embodiment

As FIG. 3 shows, if we show the stitch patterns of this embodiments tricot stitch as a refrain (a repeating pattern) of stitch positions from 1 to 9, the stitch pattern of the surface threads is shown as a refrain of 5-4/9-8/4-5/0-1, the stitch pattern of the middle threads is shown as a refrain of 0-1/1-0/1-0/0-1 and the stitch pattern of the backside threads is shown as a refrain of 4-3/7-7/3-4/0-0.

Figure 6:
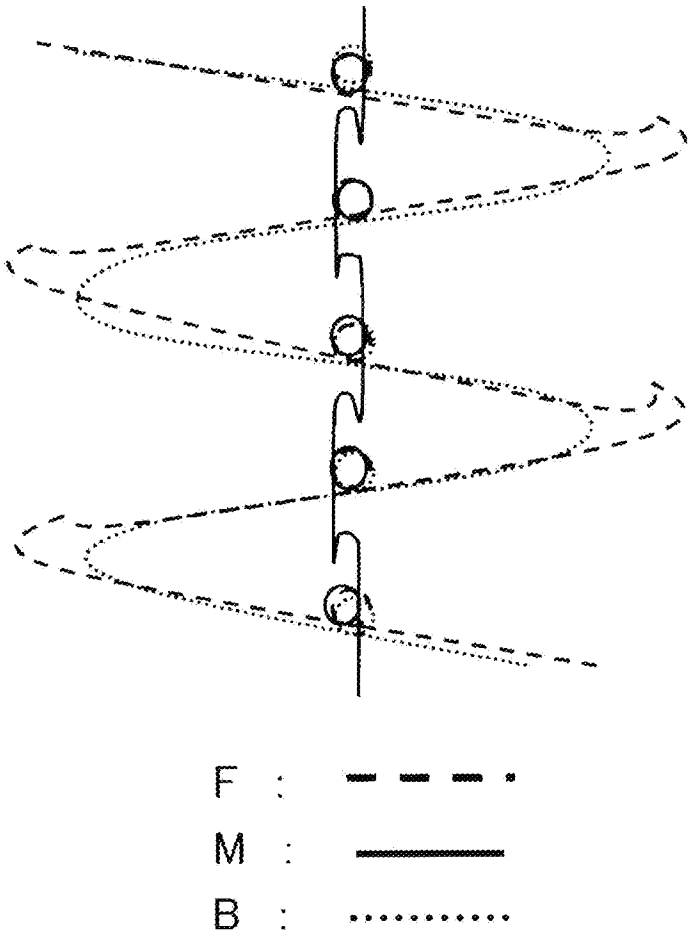
FIG. 6 is a reference view of the linking condition among surface threads, middle threads and backside threads of knitted fabric for hook-and-loop fastener according to an embodiment

FIG. 6 shows the combination in a certain line of a tricot stitch that is composed of the respective patterns of surface threads, middle threads and backside threads. Furthermore, the tricot stitch is in fact composed of several lines, as shown in FIG. 7.

Figure 7:
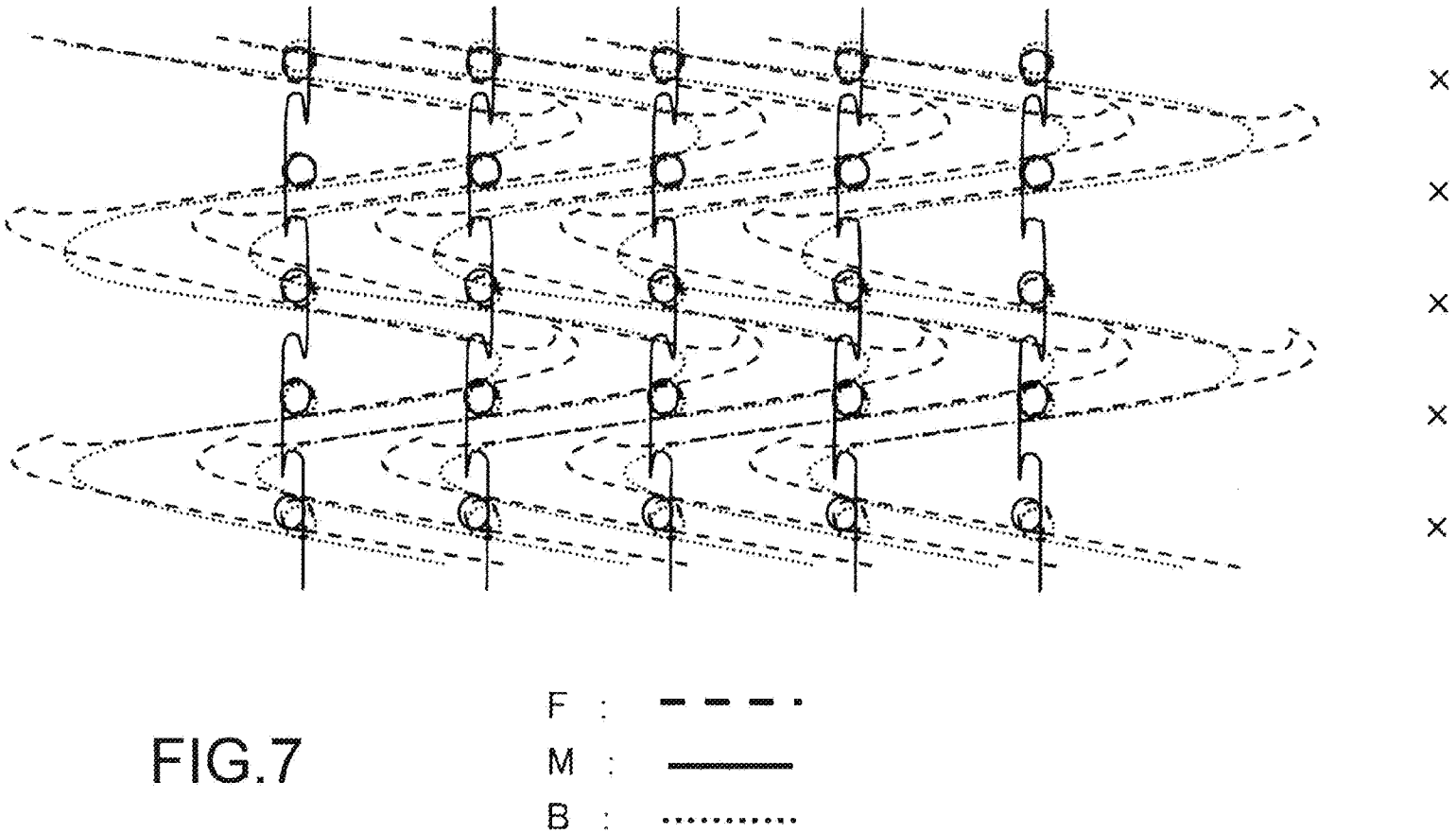
FIG. 7 is a reference view that shows the knitting condition of a knitted fabric for hook-and-loop fastener according to an embodiment

In FIG. 7, each surface thread (F) is linked to each middle thread (M) at positions marked with a cross (x), and the surface threads (F) stand up and form piles at midpoints between the crosses (x).

The tricot stitch composed of the above stitch pattern shows the following effective features in comparison with the prior art.

Figure 5:
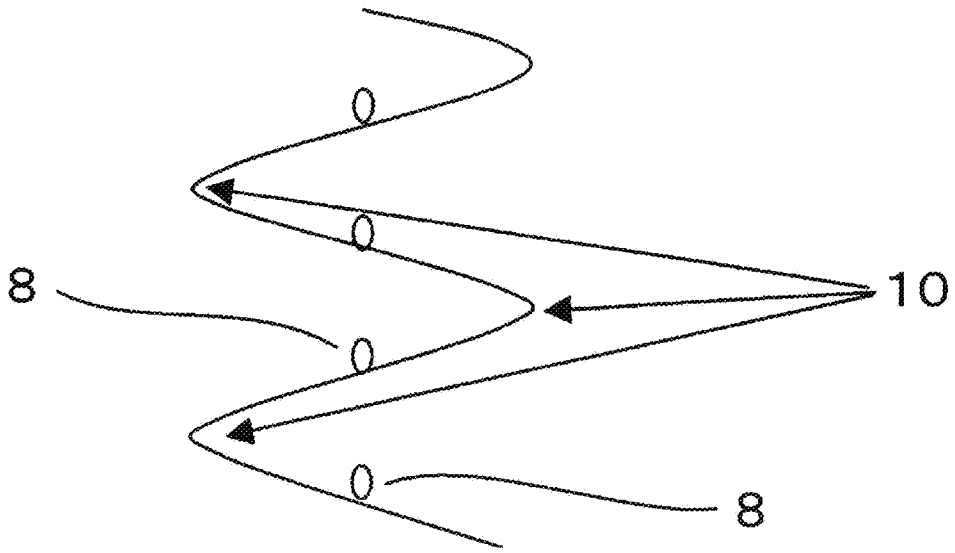
FIG. 5 is an explanatory view of backside threads of a knitted fabric for hook-and-loop fastener according to an embodiment

As FIG. 5 shows, backside threads (B) are composed of insert portions (10) that meander from side to side and loops (8) that are formed continuously at midpoint between them. Backside threads of prior arts had only insert portions, but backside threads of this invention have loops in addition to insert portions.

As FIG. 7 shows, insert portions link to the neighbor loops of middle threads (M) or surface threads (F), and backside threads form basic fabric. But if the backside threads have only insert portions, they get loose easily in the case that one portion of them is cut off. Therefore, a prior fabric had the problem that the tear strength became very weak.

The tricot stitch of this embodiment has loops (8) in addition to insert portions (10), and the loops of backside threads are linked to the loops (7) of middle threads. If a certain portion of backside threads is cut off, it is possible to keep the connection between loops of backside threads and loops of the above middle threads, because loops of backside threads linked to loops of middle threads are left at fore-and-aft of the cut-off point. Therefore, the tear strength of this invention's fabric has improved because backside threads do not get loose easily.

We demonstrate that the tear strength of this invention's fabric has improved by making loops (8) at the backside threads (M) as follows.

We prepared two kinds of fabric in five pieces. One fabric is knitted in 20-course and has both loops and insert portions at the backside threads, and the other is a fabric that is knitted in 20-course and has only the insert portions at the backside threads. We calculated their tear strength using the JIS L 1018 A criteria (Pendulum method). In this experiment, firstly, we cut off the fabric by 2 cm, secondly, we exerted a force on the fabric from center to both side, and thirdly, we measured at what force the fabric tears.

The FIG. 8 shows the result of the experiment.

In the table of FIG. 8, the numbers in parentheses in the sample columns means the sample numbers used in this experiment. Specifically, the numbers are as following:

A sample (1): a fabric that is knitted in 20-course and has loops in the backside threads.

A sample (2): a fabric that is knitted in 20-course and does not have loops in the backside threads The upper section "Wales*1" of the "tear strength" row means the tear strength values of the upper side of the fabric, namely, the tear strength values in the case where we cut off the start point of the knitting. The lower section "Wales*2" in the "tear strength" row means the tear strength values of the lower side of the fabric, namely, the tear strength values in there case where we cut off the end point of the knitting. The unit of the values is "N (Newton)", and the higher the values are, the higher the tear strength is (i.e. the stronger the fabric is).

"N=" means the number of times we measured. For example, "N=1" means the first measurement, and "N=2" means the second measurement. The course number means stitch numbers in 1-inch fabric. The higher the course number is, the denser the fabric density is.

As the table of FIG. 8 shows, we succeeded in demonstrating that the tear strength of sample (1) that has loops in the backside threads became higher than the one of sample (2), even if we cut off the fabric by 2 cm from the upper side or we cut off the fabric by 2 cm from the lower side. For example, in the case that we cut off the fabric by 2 cm from the upper side, the average of sample (1) was 6.2N and the average of sample (2) was 2.7N. On the other hand, in the case that we cut off the fabric by 2 cm from the lower side, the average of sample (1) was 6.0N and the average of sample (2) was 3.2N. Thus we succeeded in demonstrating that the tear strength of this embodiment's fabric that has loops in backside threads doubled in comparison with the fabric that does not have loops in the backside threads, in the case of fabric knitted in 20 course.

As the next experiment, we prepared two kinds of fabrics from 20 course knitting to 40 course knitting at 5 course intervals. Again, one is the fabric that has loops in the backside threads, and the other is the fabric that does not have loops in the backside threads. We measured their tear strength using the JIS L 1018 A criteria (Pendulum method).

FIG. 9 shows the result of the experiment.

In the table of FIG. 9, the numbers in parentheses in the sample columns means the sample numbers used in this experiment. Specifically, the numbers mean the following:

A sample (1): a fabric that is knitted in 20-course and has loops in the backside threads.

A sample (2): a fabric that is knitted in 25-course and has loops in the backside threads.

A sample (3): a fabric that is knitted in 30-course and has loops in the backside threads.

A sample (4): a fabric that is knitted in 35-course and has loops in the backside threads.

A sample (5): a fabric that is knitted in 40-course and has loops in the backside threads.

A sample (6): a fabric that is knitted in 20-course and does not have loops in the backside threads.

A sample (7): a fabric that is knitted in 25-course and does not have loops in the backside threads.

A sample (8): a fabric that is knitted in 30-course and does not have loops in the backside threads.

A sample (9): a fabric that is knitted in 35-course and does not have loops in the backside threads.

A sample (10): a fabric that is knitted in 40-course and does not have loops in the backside threads.

As the table of FIG. 9 shows, in the case that we cut off the fabric by 2 cm from the upper side, sample (1) was 6.2N, sample (2) was 7.1N, sample (3) was 8.7N, sample (4) was 8.9N, sample (5) was 9.1N, sample (6) was 2.8N, sample (7) was 5.9N, sample (8) was 6.9N, sample (9) was 6.9N, sample (10) was 10.3N.

On the other hand, in case that we cut off the fabric by 2 cm from the lower side, sample (1) was 6.0N, sample (2) was 6.5N, sample (3) was 7.8N, sample (4) was 9.3N, sample (5) was 9.4N, sample (6) was 2.6N, sample (7) was 4.5N, sample (8) was 5.5N, sample (9) was 6.6N, sample (10) was 10.7N.

Thus, we succeeded in demonstrating that the tear strength of sample (1) to 4) that has loops in backside threads became higher than the one of sample (6) to (9) that does not have loops in the backside threads.

We succeeded in demonstrating that the tear strength of the fabric that has loops in the backside threads increases about 1.2 to 2.3 times in comparison with the fabric that does not have loops in the backside threads, in the case of fabrics knitted with a course in the range 20 to 35 (i.e. samples (1) to (4) and (6) to (9)), though we cannot find clear differences for the fabric knitted in 40 course (i.e. samples (5) and (10)).

Therefore, using this embodiment's fabric which has loops in the backside threads, we can attach or remove this tricot stitch with engagement materials such as male materials more times, because the fabric does not tear easily.

Figure 2:
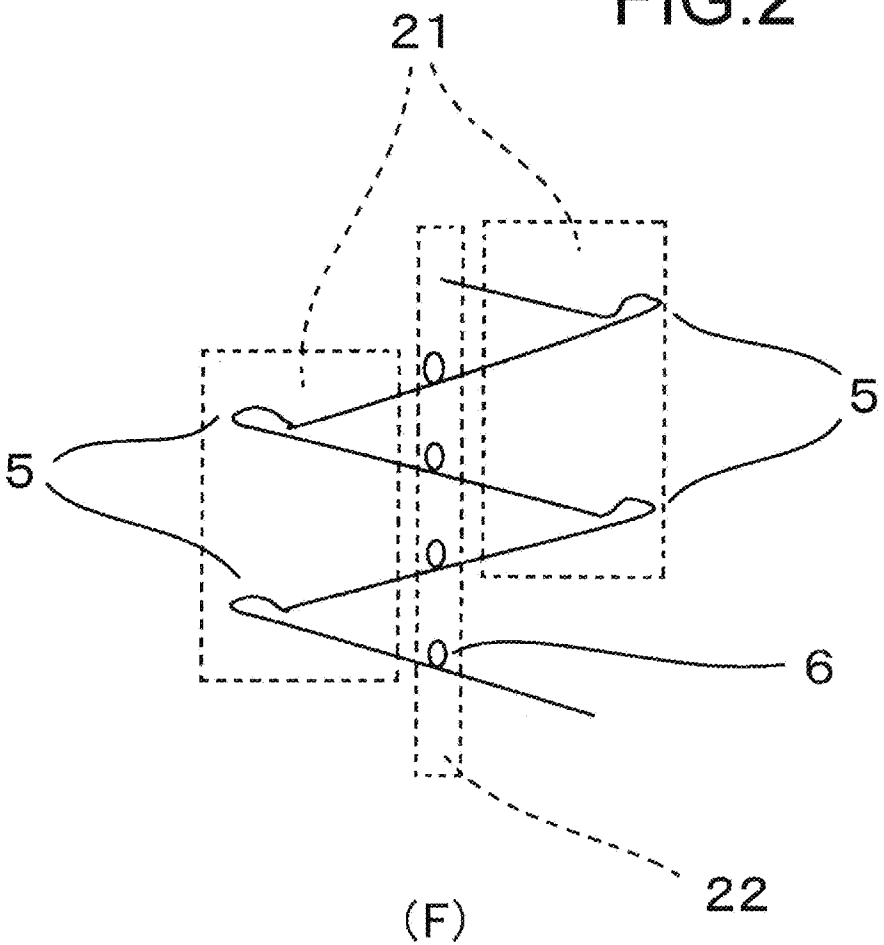
FIG. 2 is an explanatory view of surface threads of a knitted fabric for hook-and-loop fastener according to an embodiment

As FIG. 2 shows, surface threads (F) of this embodiment are composed of piles (5) that meander from side to side and loops (6) that are formed continuously at the midpoint between them. The piles do not twine into neighboring threads and stand up like a gabled arch. They form the portions that adhere to engagement materials such as male materials.

Piles (21) are evenly arranged from side to side at the center of loops in regard to the surface threads of this embodiment. That is because the fabric has the same adhesive strength in case that the engagement materials adhere to it from right or left. It is ideal to keep the piles in a vertical position. But, in fact, piles at right side stand up with a right inclination, and piles at left side stand up with a left inclination. So, if the piles are formed at only one side of the right or left, all piles stand up with the same side inclination. As a result, the adhesive strength is different in the case of adhering engagement materials from the upper right angle and adhering engagement materials from the upper left angle.

This invention's female materials (1) of a knitted fabric for a hook-and loop fastener are favourably used for a disposable paper diaper (nappy) etc. Using them for a disposable paper diaper, engagement materials are generally adhered to female materials from the right side and left side. If the adhesive strength is different in case of adhering engagement materials from the right direction and adhering engagement materials from the left direction, there are problems in such fabric because it is easy to remove the engagement materials at one side, and it is difficult to remove them at the other side. If the piles of the fabric are formed at only one of the right or left sides, it will be possible to divide the fabric into two pieces at the center line, and combine the two pieces after inverting one piece. Though it is possible to solve the above problem in this way, it gives a lot of time and trouble.

This invention's knitted fabric for a hook-and-loop fastener does not result in differences of adhesive strength even if we adhere attach engagement materials to it from both sides. So the above problem is solved because we need not consider the direction of fixing the fabric.

Piles stand up at both the right and left sides alternately, and the engagement materials easily adhere to the female materials in the case of attaching the engagement materials from the right side and the left side.

Concerning the tricot stitch (2) of this embodiment, the loops of the surface threads (F) are linked to the loops of the middle threads (M), and the loops of the middle threads (M) linked to the loops of the backside threads (B). As FIG. 3 shows, the direction of the threads of the surface loops is opposite to the direction of the threads of the middle loops, and the direction of the threads of the middle threads is opposite to the direction of the threads of the backside threads.

As a certain loop of FIG. 3 shows, in the case that the thread direction of the surface loop is anti-clockwise, the corresponding thread direction of the middle loop is clockwise. And in the case that the thread direction of the middle loop is clockwise, the corresponding thread direction of the backside loop is anti-clockwise.

Using this technique, it is possible to keep the piles higher and bigger using a little amount of thread, in the tricot stitch (2) of this embodiment. Each surface thread makes piles and loops. So, when we use a large amount of thread for a loop, that is to say, we make loops bigger, we can use a correspondingly small amount of thread for piles, that is to say, we cannot make piles bigger.

Generally speaking, it is desirable that we make the piles higher and bigger because the adhesive strength of the fabric improves. It is important for us to increase the amount of thread for piles by decreasing the amount of thread for loops.

We succeeded in keeping the amount of threads for loops lower because the direction of the loops threads were opposite in the surface threads, middle threads and backside threads.

If we make each loop small, the loops become loose because the loops have gained an opposite force to the direction of threads, as time passed. Concerning the loops of the surface threads, the middle threads and the backside threads of this embodiment, the opposite force to the direction of threads is offset, the invention results in restraining the looseness of the loops. Therefore, we can keep the piles of surface threads higher and bigger, because we can keep the loops of surface threads smaller after making the loops small.

Figure 10:
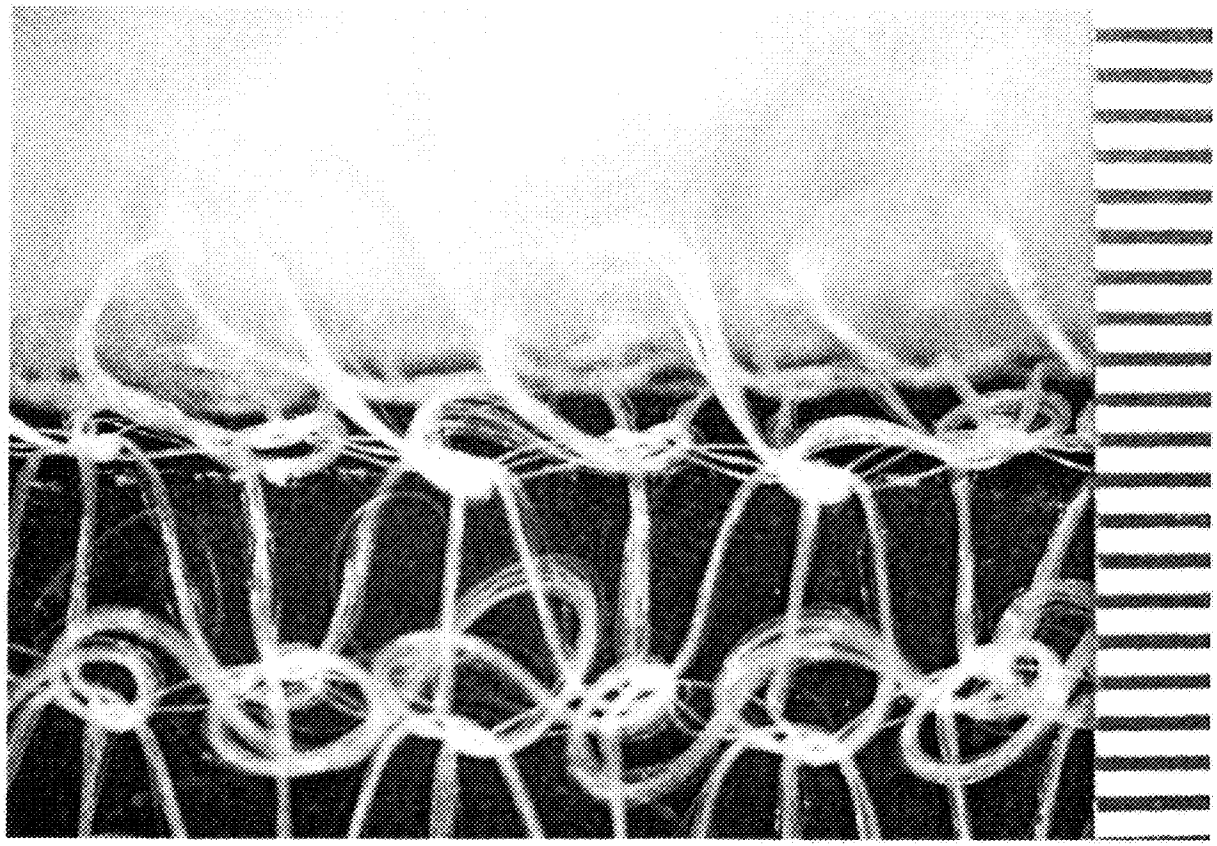
FIG. 10 is an edge side macrophotography showing piles of knitted fabric for hook-and-loop fastener according to an embodiment

FIG. 10 shows an enlargement of a certain side of this invention's fabric, in which the direction of the loops threads is opposite between the surface loops and the middle loops, and between the middle loops and the backside loops.

Figure 11:
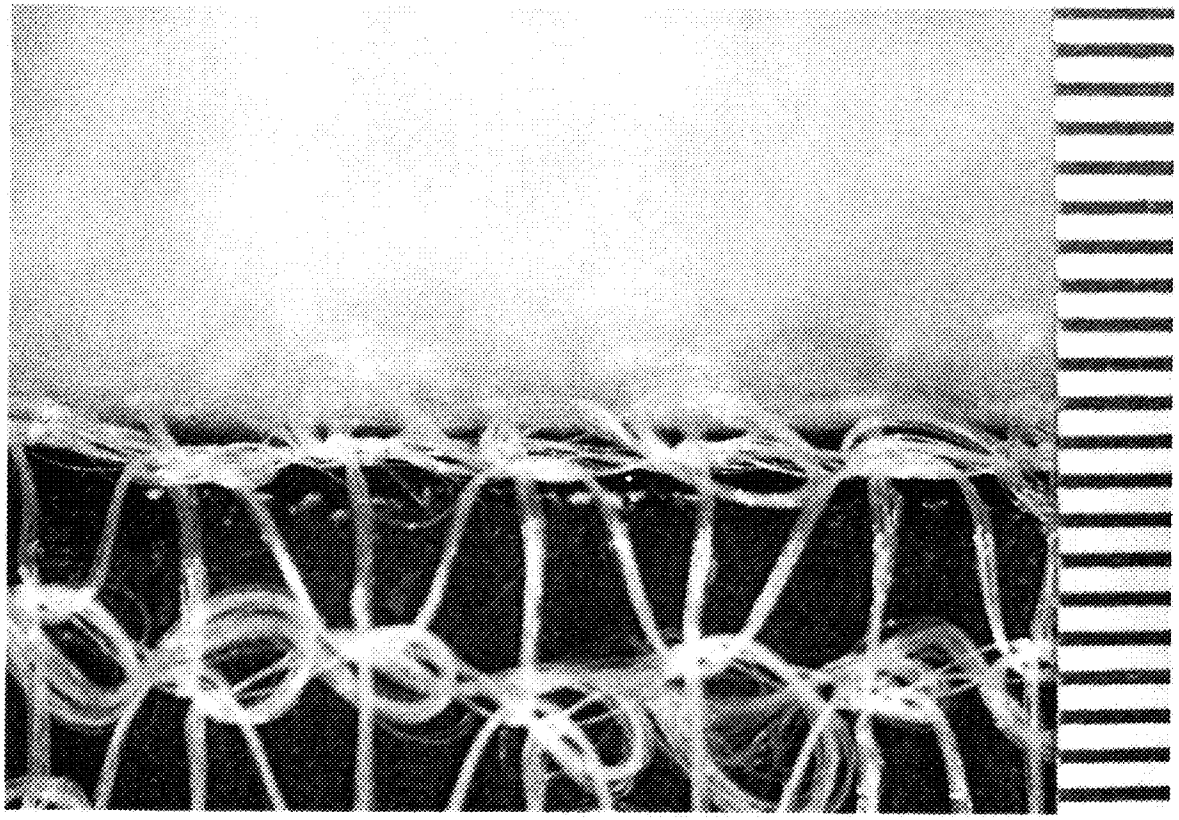
FIG. 11 is an edge side macrophotography showing piles of knitted fabric for hook-and-loop fastener according to an comparative example

FIG. 11 shows an enlargement of a certain side of comparative example's fabric, in which the direction of loops threads is same between the surface loops and the middle loops, and between the middle loops and the backside loops.

Each Figure is graduated in 0.5 mm.

Each Figure shows a circle from middle part to upper part, and the circles indicate piles that are formed by the surface threads. The piles are formed in the α (alpha) range in FIG. 10, and the piles are formed in the β (beta) range in FIG. 11.

The length of threads of fabric in FIG. 10 is the same as those of the comparative example in FIG. 11, and both of them are knitted in 20-course.

In the case that the direction of the loops threads between the surface and the middle, and between the middle and the backside is opposite to each other (i.e. this embodiment), the height shown is about 3.0 mm (about 6 graduations), as FIG. 10 shows.

On the other hand, in case that the direction of the loops threads between the surface and the middle, and between the middle and the backside is the same as each other (i.e. the comparative example), the height is about 1.0 mm (about 2 graduations), as FIG. 11 shows.

In the case that the fabrics are of the same length, it demonstrated that we could keep piles formed by loops formed in opposite directions between the surface, the middle and the backside three times as high as the piles formed by loops formed in the same direction between surface, middle and backside.

The piles easily hook on engagement materials and the adhesive strength increases with the result that we keep piles that adhere to engagement materials higher and bigger. Because we can form higher piles without using longer threads, we can cut down on expenses for threads in order to make higher piles.

Embodiment 2

Figure 4:
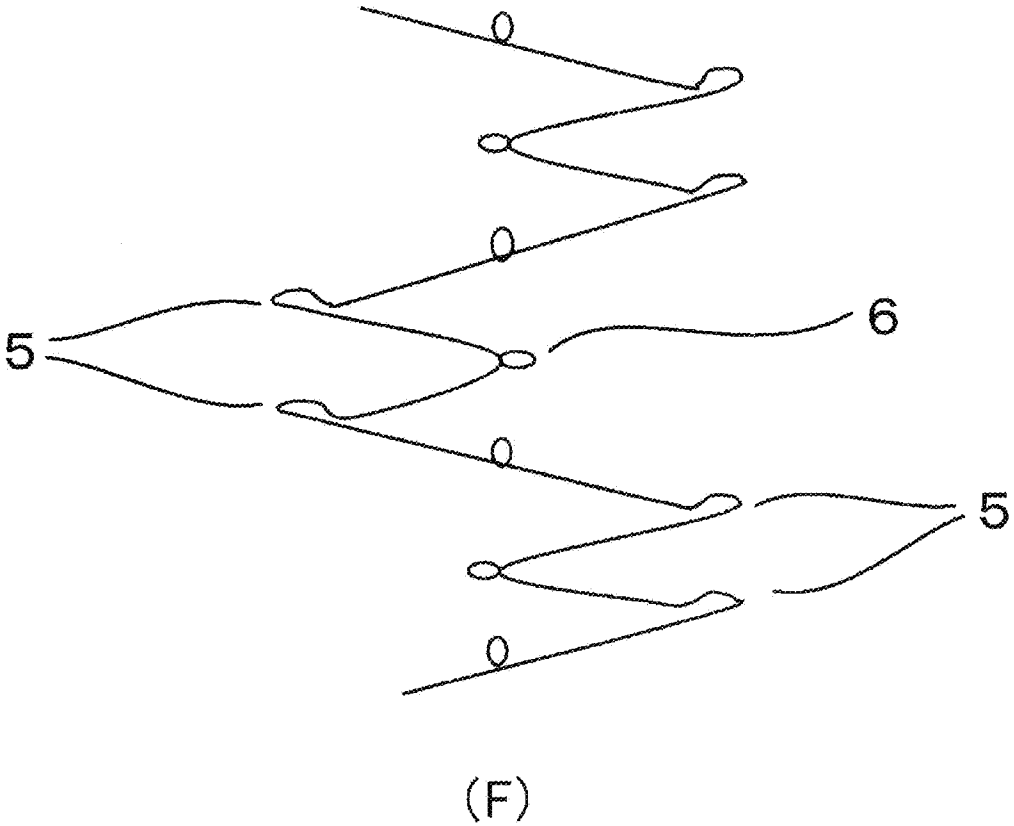
FIG. 4 is an explanatory view of surface threads of a knitted fabric for hook-and-loop fastener according to another embodiment

Referring to the FIG. 4, we will explain another embodiment for a knitted fabric for a hook-and-loop fastener according to this invention. The Tricot stitch of this embodiment is different from that of embodiment 1. Other features of this embodiment apart from the tricot stitch are the same as those of embodiment 1.

As FIG. 4 shows, if we show stitch patterns of this embodiment's tricot stitch as a refrain (repeating pattern) of stitch position from 1 to 9, the stitch pattern of the surface threads is shown as a refrain of 4-5/0-1/4-5/0-1/5-4/9-8/5-4/9-8.

That is to say, each of the two piles (5) are formed from side to side at the center of loops (6). Two piles are formed at the right side, and two piles are formed at the left side, and two piles are formed at the right side, and two piles are formed at the left side, and this pattern is repeated.

We can make piles that are inclined from side to side by using the above knitting pattern. So, the fabric by this knitting pattern gains the same adhesive strength in the case that engagement materials such as male materials are attached to it from the upper right or upper left directions, and we need not pay attention to the directions of attachment.

The tricot stitches of the above embodiments are knitted by knitting machine, raschel knitting machine and so on. Knitting gauges are preferably 7-18 gauges. Knitting courses are preferably 15-50 courses per inch. But knitting conditions are not limited to these examples, and it is possible to knit other conditions in consideration of desired adhesive strength or fabric strength.

We explain the composition of a tricot stitch by using stitch patterns in the above embodiments. But their stitch patterns are not limited to the above examples, because desired stitch patterns may change when knitting gauges or knitting arrangements change.

This invention is not limited to the above descriptions, and it is possible to arrange this invention without deviating from this invention's teaching.

REFERENCE NUMBERS

1. Female materials for hook-and-loop fastener
2. Tricot stitch
3. Cohesive layer
4. Base tape
5. Piles
6. Loops of surface threads
7. Loops of middle threads
8. Loops of backside threads
10. Insert portions of backside threads
21 Portion of piles
22. Portion that loops are linked
F. Surface threads
M. Middle threads
B. Backside threads
X. Direction of surface threads
Y. Direction of middle threads
Z. Direction of backside threads
α. (Alpha) Pile's height of this embodiment
β. (Beta) Pile's height of comparative example

The invention claimed is:

1. A knitted fabric for hook-and-loop fastener comprising:
tricot stitch for the knitted fabric for hook-and-loop fastener; and
the tricot stitch comprises surface threads, middle threads and backside threads;
wherein the surface threads form piles that are adapted to be connected to an engagement material, and the backside threads form a basic fabric by linking to their neighbor threads, and the middle threads link the surface threads with backside threads; and
wherein each surface thread, middle thread and backside thread is knitted by repeating predetermined stitch patterns; and
wherein each surface thread, middle thread and backside thread has loops at regular intervals, and loops of surface threads are linked to loops of middle threads, and loops of middle threads are linked to loops of backside threads, all of the loops being closed loops.

2. The knitted fabric for hook-and-loop fastener according to claim 1, wherein the piles of surface threads are formed from side to side in predetermined numbers.

3. The knitted fabric for hook-and-loop fastener according to claim 1, wherein the piles of surface threads are formed from side to side in equal numbers.

4. The knitted fabric for hook-and-loop fastener according to claim 1, wherein a thread direction of a loop of surface threads is opposite to a thread direction of a loop of middle threads, and the thread direction of loop of middle threads is opposite to a thread direction of a loop of backside threads.

5. The knitted fabric for hook-and-loop fastener according to claim 1, wherein, if stitch patterns of the tricot stitch are shown as a refrain of stitch positions from 1 to 9, the stitch pattern of the surface threads is shown as a refrain of 5-4/9-8/4-5/0-1, stitch pattern of the middle threads is shown as a refrain of 0-1/1-0/1-0/0-1 and stitch pattern of the backside threads is shown as a refrain of 4-3/7-7/3-4/0-0; and
a tear strength of the tricot stitch increases as a result that insert portions of backside threads are connected to neighbor threads and loops of backside threads are linked to loops of middle threads.

6. A knitted fabric for hook-and-loop fastener comprising:
a tricot stitch for the knitted fabric for hook-and-loop fastener; and
the tricot stitch comprises surface threads, middle threads and backside threads;
wherein the surface threads form piles that are adapted to be connected to an engagement material, and the backside threads form basic fabric by linking to their neighbor threads, and the middle threads link the surface threads with backside threads;
wherein each surface thread, middle thread and backside thread is knitted by repeating predetermined stitch patterns;
wherein each surface thread, middle thread and backside thread has loops at regular intervals, and loops of surface threads are linked to loops of middle threads, and loops of middle threads are linked to loops of backside threads, all of the loops be closed loops;
wherein the piles of surface threads are formed from side to side in predetermined numbers; and
wherein a thread direction of a loop of surface threads is opposite to thread direction of a loop of middle threads, and the thread direction of loop of middle threads is opposite to thread direction of a loop of backside threads.

7. The knitted fabric for hook-and-loop fastener according to claim 6, wherein, if stitch patterns of the tricot stitch are shown as a refrain of stitch positions from 1 to 9, the stitch pattern of the surface threads is shown as a refrain of 5-4/9-8/4-5/04, the stitch pattern of the middle threads is shown as a refrain of 0-1/1-0/1-0/0-1 and the stitch pattern of the backside threads is shown as a refrain of 4-3/7-7/3-4/0-0; and a tear strength of the tricot stitch increases as a result that insert portions of backside threads are connected to neighbor threads and loops of backside threads are linked to loops of middle threads.

8. A knitted fabric for hook-and-loop fastener comprising:

tricot stitch for the knitted fabric for hook-and-loop fastener; and the tricot stitch comprising surface threads, middle threads and backside threads;

wherein the surface threads form piles that are adapted to be connected to an engagement material, and the backside threads form basic fabric by linking to their neighbor threads, and the middle threads link the surface threads with backside threads;

wherein each surface thread, middle thread and backside thread is knitted by repeating predetermined stitch patterns;

wherein each surface thread, middle thread and backside thread has loops at regular intervals and loops of surface threads are linked to loops of middle threads, and loops of middle threads are linked to loops of backside threads, all of the loops being closed loops; and wherein the piles of surface threads are formed from side to side in equal numbers; and wherein a thread direction of a loop of surface threads is opposite to thread direction of a loop of middle threads, and the thread direction of loop of middle threads is opposite to thread direction of a loop of backside threads.

9. The knitted fabric for hook-and-loop fastener according to claim 8, wherein, if stitch patterns of the tricot stitch are shown as refrain of stitch position from 1 to 9, the stitch pattern of the surface threads is shown as a refrain of 5-4/9-8/4-5/0-1, the stitch pattern of the middle threads is shown as a refrain of 0-1/1-0/1-0/0-1 and the stitch pattern of the backside threads is shown as a refrain of 4-3/7-7/3-4/0-0; and a tear strength of the tricot stitch increases as a result that insert portions of backside threads are connected to neighbor threads and loops of backside threads are linked to loops of middle threads.

* * * * *